US007846495B2

(12) United States Patent
Cha et al.

(10) Patent No.: US 7,846,495 B2
(45) Date of Patent: Dec. 7, 2010

(54) METHOD OF FORMING HYDROPHOBIC COATING LAYER ON SURFACE OF NOZZLE PLATE OF INKJET HEAD

(75) Inventors: Tae-woon Cha, Seoul (KR); Jae-woo Chung, Yongin-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 1065 days.

(21) Appl. No.: 11/593,600

(22) Filed: Nov. 7, 2006

(65) Prior Publication Data

US 2007/0184193 A1 Aug. 9, 2007

(30) Foreign Application Priority Data

Feb. 3, 2006 (KR) ..... 10-2006-0010596

(51) Int. Cl.
*B05D 1/32* (2006.01)

(52) U.S. Cl. ..... 427/240; 427/282; 427/284

(58) Field of Classification Search ..... 427/240, 427/282, 284

See application file for complete search history.

(56) References Cited

U.S. PATENT DOCUMENTS

| | | | | |
|---|---|---|---|---|
| 5,985,122 | A * | 11/1999 | Conner | 205/84 |
| 2006/0141167 | A1 * | 6/2006 | Asuke | 427/487 |
| 2006/0221129 | A1 * | 10/2006 | Silverbrook | 347/45 |

* cited by examiner

*Primary Examiner*—Kirsten C Jolley
(74) *Attorney, Agent, or Firm*—Stanzione & Kim LLP

(57) ABSTRACT

An inkjet head having a hydrophobic coating layer and a method of forming the hydrophobic coating layer on a surface of a nozzle plate of the inkjet head. The method includes filling a wax into a plurality of nozzles formed in the nozzle plate while coating the surface of the nozzle plate with wax, removing the wax from the surface of the nozzle plate, forming a hydrophobic coating layer on the surface of the nozzle plate, melting the wax filled in the nozzles, and removing portions of the hydrophobic coating layer covering the nozzles by discharging the melted wax through the nozzles using heat and/or pressure. Therefore, the hydrophobic coating layer is uniformly formed only on an outer surface of the nozzle plate, without forming the hydrophobic coating layer in an inner surface of the nozzles, thereby improving an ink ejecting performance of the nozzles.

21 Claims, 3 Drawing Sheets

METHOD OF FORMING HYDROPHOBIC COATING LAYER ON SURFACE OF NOZZLE PLATE OF INKJET HEAD

CROSS-REFERENCE TO RELATED APPLICATIONS

This application claims priority under 35 U.S.C. §119(a) from Korean Patent Application No. 10-2006-0010596, filed on Feb. 3, 2006, in the Korean Intellectual Property Office, the disclosure of which is incorporated herein in its entirety by reference.

BACKGROUND OF THE INVENTION

1. Field of the Invention

The present general inventive concept relates to an inkjet head having a hydrophobic coating layer, and more particularly, to a method of forming a hydrophobic coating layer on a surface of a nozzle plate of an inkjet head.

2. Description of the Related Art

Generally, inkjet heads are devices for printing an image on a printing medium by ejecting ink droplets onto a desired region of the printing medium. Depending on an ink ejecting method, the inkjet heads can be classified into two types: a thermal inkjet head and a piezoelectric inkjet head. The thermal inkjet head generates bubbles in an ink by using heat and ejects the ink utilizing an expansion of the bubbles, and the piezoelectric inkjet head ejects an ink using pressure generated by deforming a piezoelectric material.

FIG. 1 is a sectional view illustrating a conventional piezoelectric inkjet head, and FIG. 2 is a view illustrating problems caused by a surface treatment failure at a nozzle plate of the conventional piezoelectric inkjet head of FIG. 1.

Referring to FIG. 1, a manifold 11, a plurality of restrictors 12, and a plurality of pressure chambers 13 forming an ink flow channel are formed in a flow channel plate 10 of the piezoelectric inkjet head. A vibration plate 20 which can be deformed by piezoelectric actuators 40 is bonded to a top surface of the flow channel plate 10, and a nozzle plate 30 in which a plurality of nozzles 31 are formed is bonded to a bottom surface of the flow channel plate 10. The vibration plate 20 is formed integrally with the flow channel plate 10, and the nozzle plate 30 is formed integrally with flow channel plate 10.

The manifold 11 is an ink passage supplying an ink from an ink reservoir (not shown) to the respective pressure chambers 13, and the restrictors 12 are ink passages allowing inflow of the ink from the manifold 11 to the pressure chambers 13. The pressure chambers 13 are filled with ink supplied by the manifold 11 and are arranged at one side or both sides of the manifold 11. The nozzles 31 are formed through the nozzle plate 30 and are connected to the respective pressure chambers 13. The vibration plate 20 is bonded to the top surface of the flow channel plate 10 to cover the pressure chambers 13. The vibration plate 20 is deformed by the operation of the piezoelectric actuators 40 to change pressures in the respective pressure chambers 13 to eject ink from the ink chambers 13. Each of the piezoelectric actuators 40 includes a lower electrode 41, a piezoelectric layer 42, and an upper electrode 43 sequentially stacked on the vibration plate 20. The lower electrode 41 is formed on the entire surface of the vibration plate 20 as a common electrode. The piezoelectric layer 42 is formed on the lower electrode 41 above each of the pressure chambers 13. The upper electrode 43 is formed on the piezoelectric layer 42 as a driving electrode for applying a voltage to the piezoelectric layer 42.

In the above-described piezoelectric inkjet head, a surface treatment of the nozzle plate 30 has an effect on the ink ejecting performance of the inkjet head, such as an ink ejecting speed and/or a straightness of the ink ejecting from the nozzles 31. That is, the nozzles 31 should have a hydrophilic surface, and the nozzle plate 30 should have a hydrophobic surface to increase the ink ejecting performance of the inkjet head.

Generally, a hydrophobic coating layer is formed on the nozzle plate 30 according to various known methods. Examples of conventional methods to form a hydrophobic coating layer on the nozzle plate 30 include a dipping method and a depositing method. In the dipping method, the nozzle plate 30 is dipped into a hydrophobic material solution to form a hydrophobic coating layer on the nozzle plate 30. In the depositing method, a hydrophobic material is deposited on the nozzle plate 30.

However, in both conventional coating methods, it is difficult to form a hydrophobic coating layer only on the outer surface of the nozzle plate without forming the hydrophobic coating layer on the inner surfaces of the nozzles 31. That is, the hydrophobic coating layer may be unevenly formed on the inner surfaces of the nozzles 31. In this case, as illustrated in FIG. 2, ink droplets may not be ejected straight from the nozzles 31, and a speed and volume of the ejected droplets may not be uniformly distributed, thereby deteriorating the ink ejecting performance of the inkjet head.

SUMMARY OF THE INVENTION

The present general inventive concept provides a method of forming a hydrophobic coating layer on a surface of a nozzle plate of an inkjet head, the hydrophobic coating layer being uniformly formed only on an outer surface of the nozzle plate.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept are achieved by providing a method of forming a hydrophobic coating layer on a surface of a nozzle plate of an inkjet head, the method including filling a wax into a plurality of nozzles formed in the nozzle plate while coating the surface of the nozzle plate with the wax, removing the wax from the surface of the nozzle plate, forming a hydrophobic coating layer on the surface of the nozzle plate, melting the wax filled into the nozzles, and removing portions of the hydrophobic coating layer covering the nozzles by discharging the melted wax through the nozzles.

The filling of the wax may further include manufacturing a wax solution containing the wax and a solvent, filling the wax solution into a plurality of nozzles formed in the nozzle plate while coating the surface of the nozzle plate with the wax solution, and evaporating the solvent of the wax solution.

The wax may have a melting point in a range of about 100° C. to 300° C.

The solvent of the wax solution may be selected from the group consisting of THF (tetrahydrofuran), acetone, toluene, and xylene.

The coating of the surface of the nozzle plate may include spin coating the surface of the nozzle plate with the wax solution.

The solvent may include a mixture of solvents, and the evaporating of the solvent of the wax solution may include evaporating one or more solvents of the mixture of the solvents of the wax solution.

The removing of the wax may include removing the wax using $O_2$ plasma.

The forming of the hydrophobic coating layer may be performed by depositing a hydrophobic material on the surface of the nozzle plate to a predetermined thickness.

The hydrophobic material may be a fluoride compound.

The hydrophobic coating layer may not be formed in an inner surface of the nozzles.

The removing of portions of the hydrophobic coating layer includes applying a pressure and/or a heat to the wax.

The method of forming a hydrophobic coating layer on a surface of a nozzle plate of an inkjet head, wherein the nozzle plate of the inkjet head may comprise a nozzle plate of an assembled inkjet head having a pressure chamber and an actuator, may be performed on the assembled inkjet head.

The inkjet head may include a plurality of pressure chambers corresponding to the nozzles, and the pressure chambers may be filled with the wax when the nozzles are filled with the wax.

The melting of the wax filled into the nozzles may include melting of the wax filled into the pressure chambers.

The inkjet head may further include a piezoelectric actuator providing an ink ejecting force to each of the pressure chambers, and the melted wax may be discharged through the nozzles by a pressure generated by the piezoelectric actuator.

The foregoing and/or other aspects and utilities of the present general inventive concept are also achieved by providing a method of forming a hydrophobic coating layer on a surface of a nozzle plate of an inkjet head, the method including filling a wax into a plurality of nozzles formed in the nozzle plate of an inkjet head while coating the surface of the nozzle plate with the wax, removing the wax from the surface of the nozzle plate, forming a hydrophobic coating layer on the surface of the nozzle plate, and removing the wax from the nozzles.

The filling of the wax may include manufacturing a wax solution containing the wax and a solvent, filling the wax solution into a plurality of nozzles formed in the nozzle plate while coating the surface of the nozzle plate with the wax solution, and evaporating the solvent of the wax solution.

The removing of the wax from the nozzles may also include melting the wax in the nozzles, and applying a pressure and/or heat to the wax in the nozzles to discharge the wax through the nozzles while removing portions of the hydrophobic coating layer covering the nozzles.

The hydrophobic coating layer may not be formed in an inner surface of the nozzles.

The foregoing and/or other aspects and utilities of the present general inventive concept are also achieved by providing an inkjet head including a nozzle plate having a hydrophobic coating layer formed on a surface of the nozzle plate and comprising a plurality of nozzles, wherein the hydrophobic coating layer is not formed on an inner surface of the nozzles.

The inkjet head may include nozzles with a hydrophilic inner surface.

According to the present general inventive concept, the hydrophobic coating layer can be uniformly formed only on the outer surface of the nozzle plate, without forming the hydrophobic coating layer in the inner surfaces of the nozzles, thereby improving the ink ejecting performance of the inkjet head.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
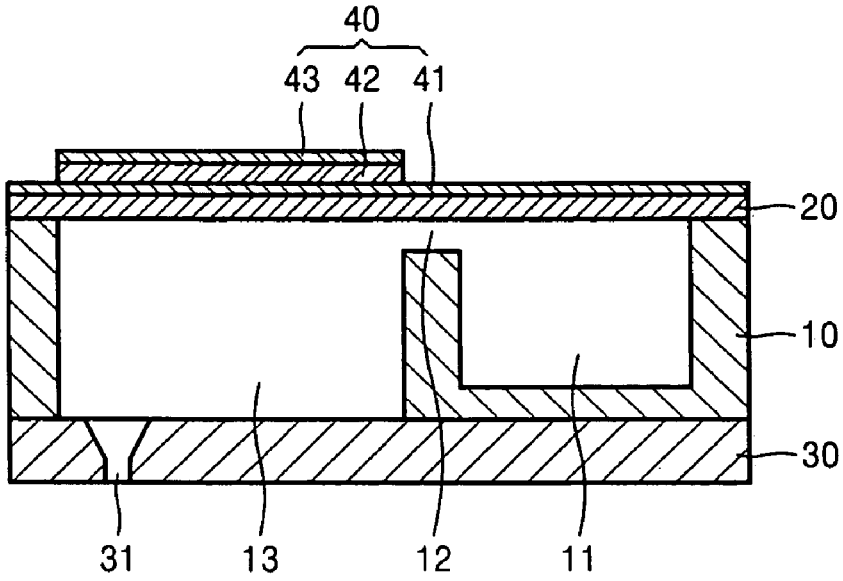
FIG. 1 (PRIOR ART)
FIG. 1 is a cross-sectional view illustrating a conventional piezoelectric inkjet head.
Figure 2:
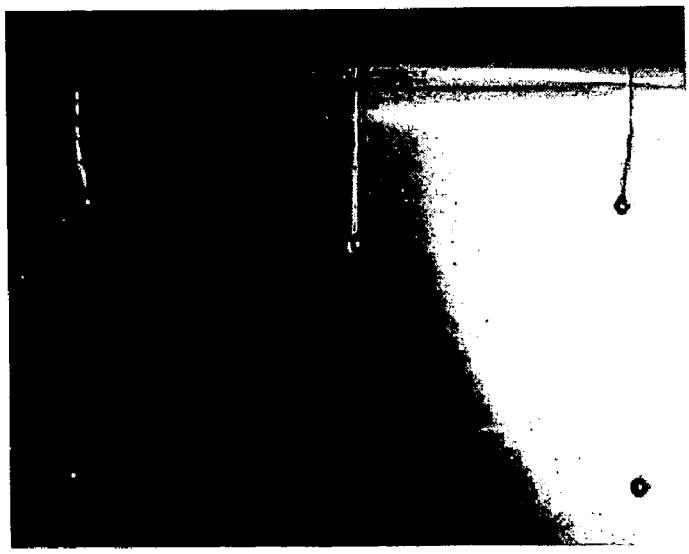
FIG. 2 (PRIOR ART)
FIG. 2 is a view illustrating problems caused by a surface treatment failure at a nozzle plate of the conventional piezoelectric inkjet head of FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIGS. 3A through 3D are views illustrating a method of forming a hydrophobic coating layer on a surface of a nozzle plate of an inkjet head according to an embodiment of the present general inventive concept. Although FIGS. 3A through 3D illustrate a portion of the nozzle plate the present general inventive concept is not limited thereto. It is possible that the nozzle plate may have several tens to several hundreds of nozzles arranged in one or more lines.

Figure 3A:
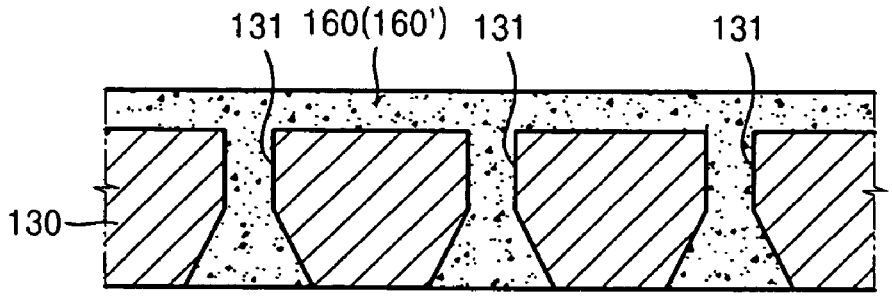
FIGS. 3A through 3D are views illustrating a method of forming a hydrophobic coating layer on a surface of a nozzle plate of an inkjet head according to an embodiment of the present general inventive concept.

Referring to FIG. 3A, a nozzle plate 130 having a plurality of nozzles 131 is prepared, and a wax solution 160 is formed on a surface of the nozzle plate 130 and filled into the nozzles 131. The nozzle plate 130 may be formed of a silicon wafer, a glass substrate, a metal substrate, or the like. The wax solution 160 may be formed by dissolving solid wax 160' in a solvent such as tetrahydrofuran (THF), acetone, toluene, or xylene up to about 20 wt % of the solid wax 160'. The solid wax 160' may have a melting point in a range of about 100° C. to 300° C. The wax solution 160 can be filled into the nozzles 131 by coating the surface of the nozzle plate 130 with the wax solution 160 up to a predetermined thickness through spin coating. Next, the wax solution 160 is dried for a predetermined amount of time to evaporate the solvent, and thus only the solid wax 160' remains.

Figure 3B:
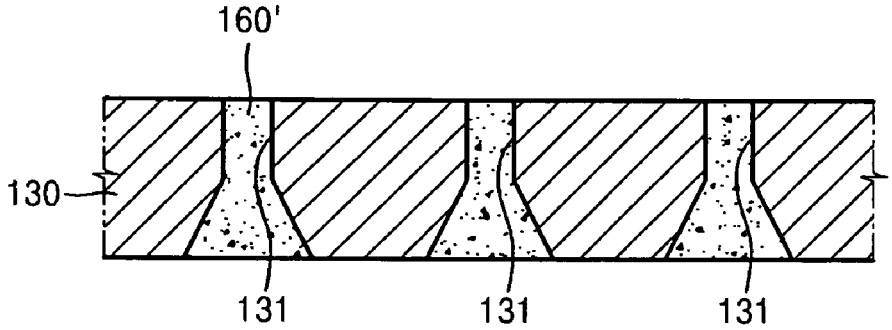

Referring to FIG. 3B, the solid wax 160' is removed from the surface of the nozzle plate 130. The solid wax 160' may be removed from the surface of the nozzle plate using $O_2$ plasma. Then, the solid wax 160' remains only in the nozzles 131.

Figure 3C:
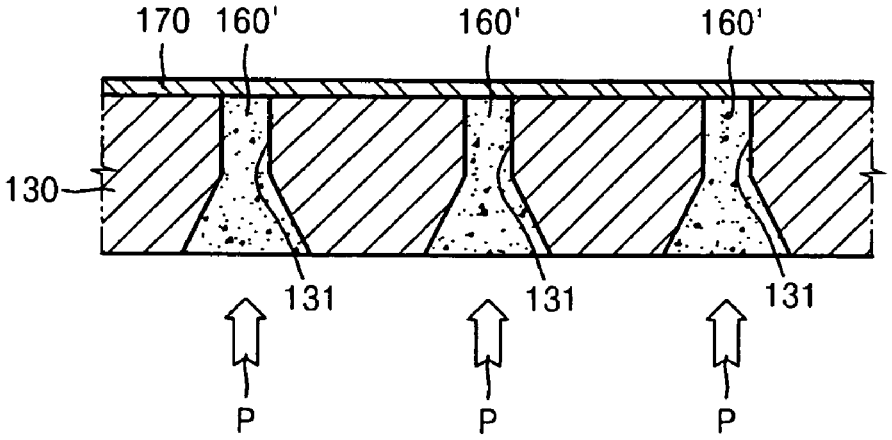

Referring to FIG. 3C, a hydrophobic coating layer 170 is formed on the surface of the nozzle plate 130. The hydrophobic coating layer 170 may be formed, for example, by depositing a hydrophobic material on the surface of the nozzle plate 130 to a predetermined thickness, for example, a thickness of about 20 nm. The hydrophobic material is not deposited in the nozzles 131 since the nozzles 131 are filled with the solid wax 160'. Various kinds of hydrophobic materials, such as fluoride compounds, can be used for the hydrophobic material.

Figure 3D:
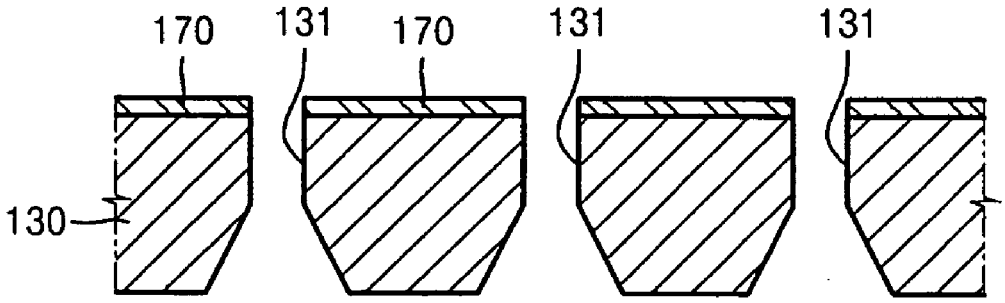

After the hydrophobic coating layer 170 is formed on the surface of the nozzle plate 130 as described above, the nozzle plate 130 is heated to a predetermined temperature in order to melt the solid wax 160' disposed in the nozzles 131. Next, a pressure P is applied to the wax 160' filled in the nozzles 131 to discharge the wax 160' to an outside thereof through the nozzles 131. Portions of the hydrophobic coating layer 170 that covers the nozzles 131 are removed by the wax 160' discharged through the nozzles 131. Therefore, as shown in FIG. 3D, the hydrophobic coating layer 170 remains only on an outer surface of the nozzle plate 130.

Through the above-described operations, and according to various embodiments of the present general inventive concept, the hydrophobic coating layer 170 can be uniformly formed only on the outer surface of the nozzle plate 130. That is, inner surfaces of the nozzles 131 are not coated with the hydrophobic coating layer 170.

While in the above-described embodiment, the hydrophobic coating layer 170 is formed on the nozzle plate 130 before the nozzle plate 130 is bonded to an inkjet head, the present general inventive concept is not limited thereto. As described below, the hydrophobic coating layer 170 can be formed on the outer surface of the nozzle plate 130 after the nozzle plate 130 is bonded to an inkjet head.

Figure 4:
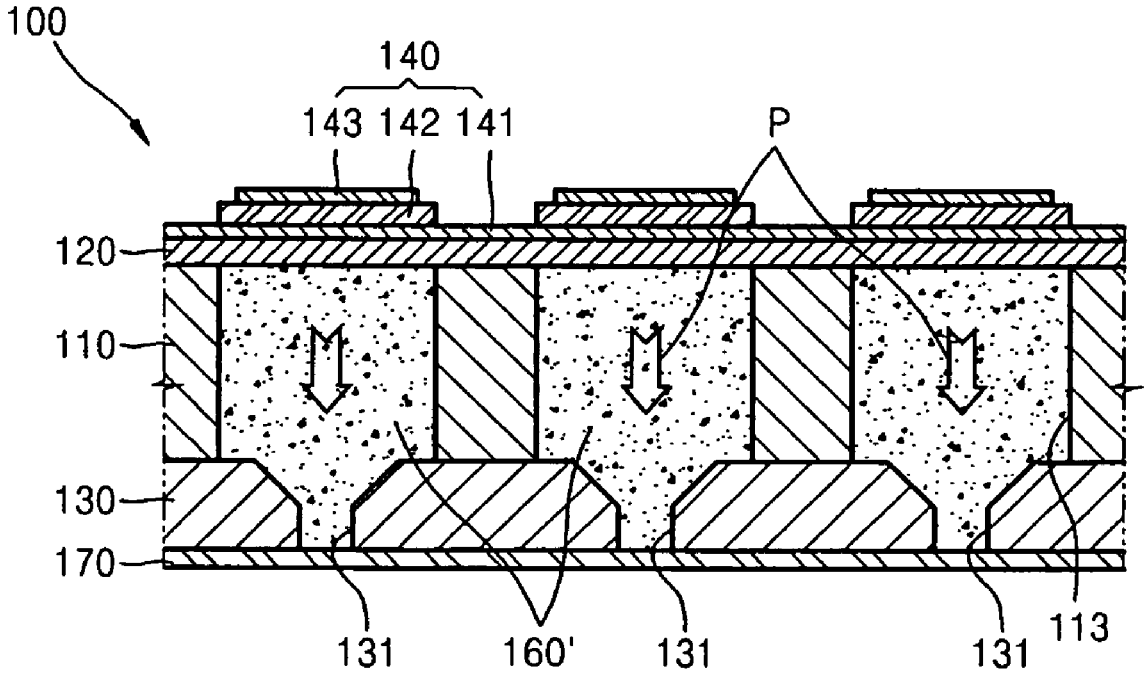
FIG. 4 is a view illustrating a method of forming a hydrophobic coating layer on a surface of a nozzle plate of an inkjet head according to an embodiment of the present general inventive concept.

FIG. 4 is a view illustrating a method of forming a hydrophobic coating layer on a surface of a nozzle plate of an inkjet head 100 according to an embodiment of the present general inventive concept.

Referring to FIG. 4, the inkjet head 100 includes a flow channel plate 110 having a plurality of pressure chambers 113, a vibration plate 120 bonded to a top surface of the flow channel plate 110 and to cover the plurality of pressure chambers 113, and piezoelectric actuators 140 formed on the vibration plate 120. The inkjet head 100 further includes a nozzle plate 130 that is bonded to a bottom surface of the flow channel plate 110 and has a plurality of nozzles 131 formed therethrough. The flow channel plate 110 may include a manifold (not shown) and a plurality of restrictors (not shown). The piezoelectric actuators 140 provide ink with ejecting forces to the respective pressure chambers 113. Each of the piezoelectric actuators 140 includes a lower electrode 141, a piezoelectric layer 142, and an upper electrode 143 that are sequentially formed on the vibration plate 120. The lower electrode 141 is formed on the entire top surface of the vibration plate 120 as a common electrode. The piezoelectric layer 142 is formed on the lower electrode 141 above each of the pressure chambers 113. The upper electrode 143 is formed on the piezoelectric layer 142 as a driving electrode for applying a voltage to the piezoelectric layer 142.

The vibration plate 120 may be formed integrally with the flow channel plate 110, and the nozzle plate 130 may also be formed integrally with the flow channel plate 110.

The operations illustrated in FIGS. 3A through 3D can be performed on the completely assembled inkjet head 100. In this case, wax 160' is filled in the pressure chambers 113 as well as the nozzles 131. Thereafter, the entire inkjet head 100 including the nozzle plate 130 is heated to melt the wax 160' and then the melted wax 160' is discharged to the outside through the nozzles 131. Here, the piezoelectric actuators 140 can be operated to vibrate the vibration plate 120 and thus generate pressures P for discharging the melted wax 160'. When the melted wax 160' is discharged through the nozzles 131, portions of a hydrophobic coating layer 170 that cover the nozzles 131 are removed as shown in FIG. 3D. Therefore, the hydrophobic coating layer 170 remains only on the outer surface of the nozzle plate 130.

As described above, according to the method of forming the hydrophobic coating layer, the hydrophobic coating layer can be uniformly formed only on the outer surface of the nozzle plate, without it forming on the inner surfaces of the nozzles.

Therefore, the ink ejecting performance of the inkjet head, such as the ink ejecting speed and the straightness of the ink ejecting from the nozzles, can be improved and thus the printing quality of the inkjet head can be improved.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of forming a hydrophobic coating layer on a surface of a nozzle plate of an inkjet head, comprising:

filling a wax into a plurality of nozzles formed in the nozzle plate while coating the surface of the nozzle plate with the wax;

removing the wax from the surface of the nozzle plate;

forming a hydrophobic coating layer on the surface of the nozzle plate;

melting the wax filled into the nozzles; and removing portions of the hydrophobic coating layer covering the nozzles by discharging the melted wax through the nozzles.

2. The method of claim 1, wherein the filling of the wax comprises:

manufacturing a wax solution containing the wax and a solvent;

filling the wax solution into a plurality of nozzles formed in the nozzle plate while coating the surface of the nozzle plate with the wax solution; and evaporating the solvent of the wax solution.

3. The method of claim 2, wherein the wax has a melting point in a range of about 100° C. to 300° C.

4. The method of claim 2, wherein the solvent of the wax solution is selected from the group consisting of THF (tetrahydrofuran), acetone, toluene, and xylene.

5. The method of claim 2, wherein the coating of the surface of the nozzle plate comprises spin coating the surface of the nozzle plate with the wax solution.

6. The method of claim 2 wherein the solvent comprises a mixture of solvents, and the evaporating of the solvent of the wax solution comprises evaporating one or more solvents of the mixture of the solvents of the wax solution.

7. The method of claim 1, wherein the forming of the hydrophobic coating layer is performed by depositing a hydrophobic material on the surface of the nozzle plate to a predetermined thickness.

8. The method of claim 7, wherein the hydrophobic material is a fluoride compound.

9. The method of claim 1 wherein the hydrophobic coating layer is not formed in an inner surface of the nozzles.

10. The method of claim 1 wherein the removing of the portions of the hydrophobic coating layer comprises applying a pressure and/or a heat to the wax.

11. The method of claim 1, wherein the nozzle plate of the inkjet head comprises a nozzle plate of an assembled inkjet head having a pressure chamber and an actuator, and the method is performed on the assembled inkjet head.

12. The method of claim 11, wherein the inkjet head comprises a plurality of pressure chambers corresponding to the nozzles, and the pressure chambers are filled with the wax when the nozzles are filled with the wax.

13. The method of claim 12, wherein the melting of the wax filled into the nozzles comprises melting the wax filled into the pressure chambers.

14. The method of claim 1, wherein the melted wax is discharged through the nozzles by deforming a piezoelectric material.

15. A method of forming a hydrophobic coating layer on a surface of a nozzle plate of an inkjet head, comprising:

filling a wax into a plurality of nozzles formed in the nozzle plate of an inkjet head while coating the surface of the nozzle plate with the wax;

removing the wax from the surface of the nozzle plate;

forming a hydrophobic coating layer on upper surfaces of the nozzles containing the wax and on an upper surface of the nozzle plate after removing the wax from the nozzle plate; and removing the wax from the nozzles.

16. The method of claim 15 wherein the filling of the wax comprises:

manufacturing a wax solution containing the wax and a solvent;

filling the wax solution into a plurality of nozzles formed in the nozzle plate while coating the upper surface of the nozzle plate with the wax solution; and evaporating the solvent of the wax solution.

17. The method of claim 15 wherein the removing of the wax from the nozzles comprises:

melting the wax in the nozzles; and applying a pressure and/or heat to the wax in the nozzles to discharge the wax through the nozzles while removing portions of the hydrophobic coating layer covering the nozzles.

18. The method of claim 15 wherein the hydrophobic coating layer is not formed in an inner surface of the nozzles.

19. The method of claim 15, further comprising discharging portions of the hydrophobic coating layer on the upper surfaces of the nozzles by deforming a piezoelectric material.

20. A method of forming a hydrophobic coating layer on a surface of a nozzle plate of an inkjet head, comprising:

filling a wax into a plurality of nozzles formed in the nozzle plate while coating the surface of the nozzle plate with the wax;

removing the wax from the surface of the nozzle plate;

forming a hydrophobic coating layer on the surface of the nozzle plate;

melting the wax filled into the nozzles; and removing portions of the hydrophobic coating layer covering the nozzles by discharging the melted wax through the nozzles, wherein the removing of the wax comprises removing the wax using $O_2$ plasma.

21. A method of forming a hydrophobic coating layer on a surface of a nozzle plate of an assembled inkjet head, comprising:

filling a wax into a plurality of nozzles formed in the nozzle plate while coating the surface of the nozzle plate with the wax;

removing the wax from the surface of the nozzle plate;

forming a hydrophobic coating layer on the surface of the nozzle plate;

melting the wax filled into the nozzles; and removing portions of the hydrophobic coating layer covering the nozzles by discharging the melted wax through the nozzles, wherein the nozzle plate of the assembled inkjet head comprises a nozzle plate having a plurality of pressure chambers to correspond to the plurality of nozzles and an actuator, wherein the pressure chambers are filled with the wax when the nozzles are filled with the wax, and wherein the assembled inkjet head further comprises a piezoelectric actuator providing an ink ejecting force to each of the pressure chambers, and the melted wax is discharged through the nozzles by a pressure generated by the piezoelectric actuator.

* * * * *